United States Patent [19]

Ball, Jr. et al.

[11] Patent Number: 4,902,999

[45] Date of Patent: Feb. 20, 1990

[54] ENCLOSED BIMETAL CIRCUIT BREAKER

[75] Inventors: George A. Ball, Jr., Cape Elizabeth; John L. Schneider, Raymond, both of Me.

[73] Assignee: GTE Products Corporation, Stamford, Conn.

[21] Appl. No.: 315,663

[22] Filed: Feb. 27, 1989

[51] Int. Cl.[4] ..... H01H 37/04; H01H 37/12

[52] U.S. Cl. ..... 337/372; 337/353; 337/368; 337/380

[58] Field of Search ..... 337/53, 102-107, 337/99, 100, 101, 368, 380, 372

[56] References Cited

U.S. PATENT DOCUMENTS

| | | | |
|---|---|---|---|
| 3,090,847 | 5/1963 | Colautti et al. | 337/105 |
| 3,131,270 | 4/1964 | Kurz | 337/53 |
| 4,663,606 | 5/1987 | Carbone | 337/368 |

*Primary Examiner*—H. Broome

*Attorney, Agent, or Firm*—James Theodosopoulos

[57] ABSTRACT

An electrical circuit breaker comprises a base with two terminals embedded in, and extending through, the base. The external plug-in portions of the terminals are centered on the base. The internal portions of the terminals are off to one side in order to accommodate a PMB bimetal mounted on said internal portions. A cover secured to the base encloses the PMB bimetal.

5 Claims, 2 Drawing Sheets

ENCLOSED BIMETAL CIRCUIT BREAKER

This invention concerns electrical circuit breakers of the type employing a positive make and brake (PMB) bimetal. Such a PMB bimetal comprises a compensator fastened to a U shaped armature. Examples of such circuit breakers are disclosed in U.S. Pat. Nos. 2,585,068, 4,521,760, 4,636,766 and 4,663,606.

It has become desirable to replace certain automotive fuse elements with PMB circuit breakers. Such PMB circuit breakers can be made suitable for high ambient temperature operation. However the size of the enclosed PMB circuit breaker should not be increased over that of the fuse element. We have found, for this purpose, that the PMB bimetal should be disposed in a substantially parallel relationship with the flat plug-in terminals of the circuit breaker unit. Furthermore, the terminals have a slight angle bend so that even though the external plug-in portions thereof are centered on the circit breaker unit, the internal portions on which the PMB bimetal assembly is mounted are off-center to one side in order to accommodate the PMB bimetal assembly.

Figure 1:
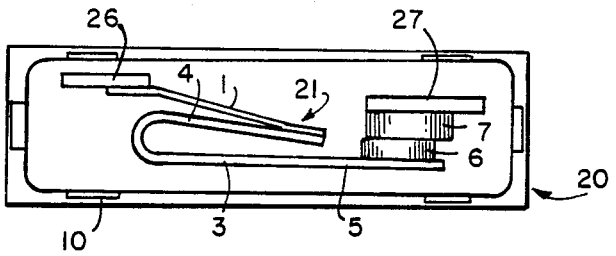
FIG. 1 is a plan view.
Figure 2:
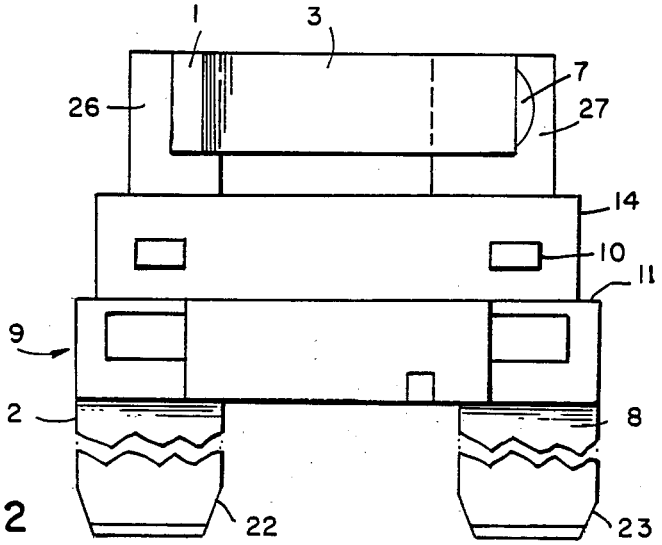
FIGS. 2 and 3 are front and side elevational views of one example of a circuit breaker in accordance with this invention.

As shown in FIG. 1, circuit breaker unit 20 contains a PMB bimetal assembly 21 which comprises a compensator 1 and a U shaped armature 3. Compensator 1 is fastened, such as by welding, to upper portion 26 of terminal 2 at one end, the other end of compensator 1 being fastened to U shaped armature 3. U shaped armature 3 has a shorter leg 4 and a longer leg 5. Compensator 1 is fastened to the end of shorter leg 4. There is a contact 6 at the end of longer leg 5. Contact 6 is, during normal operation, in physical and electrical contact with a fixed contact 7 mounted on upper portion 27 of terminal 8.

In FIG. 1, the upper surface of compensator 1 is the low expansion layer of the bimetal and the lower surface is the high expansion metal. Thus, as the temperature of the circuit breaker increases, the end of compensator 1 which is fastened to U shaped armature 3 tends to move upwards, thereby increasing contact pressure between contact 6 and contact 7. For U shaped armature 3, the high expansion layer is the inner surface of the U and the low expansion layer is the outer surface. Thus, as the temperature of the circuit breaker increases, the contact end of U shaped armature 3 tends to move downward, thereby decreasing contact pressure between contact 6 and contact 7. When the circuit breaker reaches its rated opening temperature or current, the opening pressure of U shaped armature 3 overcomes the closing pressure of compensator 1, and contacts 6 and 7 separate, thereby opening the electrical circuit.

In one example, compensator 1 was 17 mils thick by 550 mils long by 218 mils wide. U shaped armature 3 was 20 mils thick by 218 wide and had an overall length of 1121 mils. The length of longer leg 5 was about 680 mils and the length of shorter leg 4 was about 420 mils.

Figure 3:
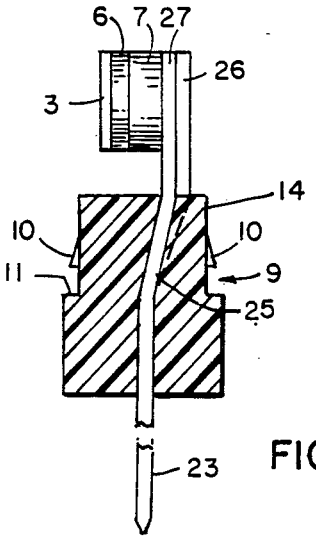
Figure 4:
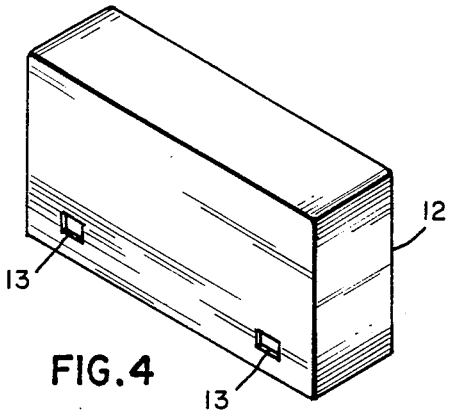
FIG. 4 shows a cover.
Figure 5:
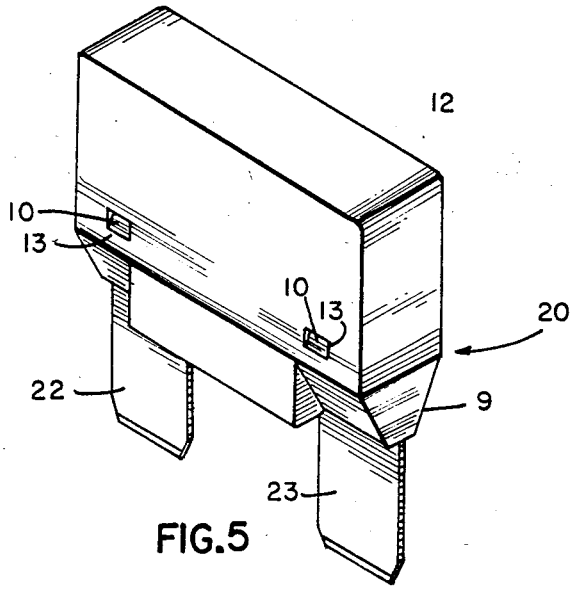
FIG. 5 shows the enclosed circuit breaker unit.

As shown in the drawing, PMB bimetal 21 is in a substantially parallel relationship with terminals 2 and 8. Terminals 2 and 8 comprise lower plug-in portions 22 and 23, embedded bent portions (only bent portion 25 of terminal 8 is shown in FIG. 3), and internal upper portions 26 and 27 to which PMB bimetal 21 is fastened. Substantially parallel relationship is meant to distinguish over a substantially transverse relationship, such as shown in U.S. Pat. No. 4,663,606, and means that the plane which contains longer leg 5 of PMB bimetal 21 is substantially parallel to the plane which contains the centered plug-in portions 22 and 23 of terminals 2 and 8.

The bent portions (bent portion 25 only is shown) of terminals 2 and 8 are embedded in plastic base 9 and bend toward the right hand side of unit 20 as shown in FIG. 3. This places upper portions 26 and 27 of terminals 2 and 8 towards the right and provides room to accommodate PMB bimetal 21 without necessitating an increase in the size of the circuit breaker package, as would be required without the bend in terminals 2 and 8. As shown in FIG. 3, plug-in portions (only plug-in portion 23 is shown) of terminals 2 and 8 are centrally positioned on base 9.

Circuit breaker 20 is enclosed by means of plastic cover 12 which slips over upper portion 14 of base 9 and can bear against landed surface 11 of base 9. Cover 12 is secured on base 9 by means of slightly protruding snap tabs 10 which fit into matching holes 13 in cover 12.

We claim:

1. An electrical circuit breaker comprising a base, two terminals, a PMB bimetal and a cover; the PMB bimetal comprising a compensator fastened to a U shaped armature, the U shaped armature having a shorter leg and a longer leg; the terminals having inner portions within the cover and also having external plug-in portions; the terminals being embedded in, and extending through, the base; the base having a longitudinal center line; the external plug-in portions of the terminals being located on said longitudinal center line an extending perpendicularly therefrom; the embedded portions of the terminals being bent at a slight angle so that the inner portions of the terminals are offset from said longitudinal center line; the PMB bimetal being fastened to the inner portion of one of the terminals and making contact, when closed, to a contact on the inner portion of the other terminal, the PMB bimetal being in a substantially parallel relationship with the external plug-in portions of the terminals.

2. The circuit breaker of claim 1 wherein the base has a landed surface and wherein the cover rests against said landed surface when the cover is secured to the base.

3. The circuit breaker of claim 1 wherein the cover is secured to the base by means of snap tabs on the base fitting into matching holes in the cover.

4. The circuit breaker of claim 1 wherein one end of the compensator is fastened to the shorter leg of the armature and the other end of the compensator is fastened to the inner portion of one of the terminals.

5. The circuit breaker of claim 4 wherein the longer leg of the armature is fastened to a contact which is in electrical contact with the inner portion of the other terminal.

* * * * *